US005248952A

United States Patent [19]

Bisbee

[11] Patent Number: 5,248,952

[45] Date of Patent: Sep. 28, 1993

[54] TRANSFORMER CORE AND METHOD FOR FINISHING

[75] Inventor: Phillip I. Bisbee, Versailles, Ky.

[73] Assignee: Kuhlman Corporation, Lexington, Ky.

[21] Appl. No.: 820,708

[22] Filed: Jan. 14, 1992

[51] Int. Cl.[5] ..... H01F 27/26; H01F 41/02

[52] U.S. Cl. ..... 336/213; 29/609; 156/291; 336/219; 428/37; 428/900

[58] Field of Search ..... 336/219, 213, 234, 233; 29/605, 609, 606; 428/37, 900, 34.1; 156/290, 291, 191

[56] References Cited

U.S. PATENT DOCUMENTS 4,599,594 7/1986 Siman .
4,615,106 10/1986 Grimes et al. .
4,648,929 3/1987 Siman .
4,663,605 5/1987 Lee .
4,673,907 6/1987 Lee .
4,707,678 11/1987 Siman .
4,709,471 12/1987 Valencic et al. .
4,734,975 4/1988 Ballard et al. .
4,741,096 5/1988 Lee et al. .
4,789,849 12/1988 Ballard et al. .
4,790,064 12/1988 Ballard et al. .
4,847,987 7/1989 Ballard .
4,892,773 1/1990 Chenoweth et al. .
4,893,400 1/1990 Chenoweth .
4,903,396 2/1990 Grimes et al. .
4,910,863 3/1990 Valencic et al. .
4,924,201 5/1990 Ballard .
4,972,573 11/1990 Yamamoto et al. .

*Primary Examiner*—Thomas J. Kozma
*Attorney, Agent, or Firm*—Townsend and Townsend Khourie and Crew

[57] ABSTRACT

A finished transformer core (48) includes a core (2) of wound amorphous transformer core material (4) to which rigidifying bonding material (22) is applied to the ends (12, 14) of the core. The bonding material does not cover the entire ends but leaves gaps (24) to permit fluid flow between the ambient environment and the inter-lamination voids (16) which exist between the layers (18, 20) of the wound material. The core, rigidified by the bonding material, is housed within a fluid permeable containment assembly (28). The containment assembly typically includes fluid permeable filter material (32, 34, 36, 38) which allows transformer oil and air to pass through the material but will trap solid particles of core material within the containment assembly.

18 Claims, 1 Drawing Sheet

TRANSFORMER CORE AND METHOD FOR FINISHING

BACKGROUND OF THE INVENTION

Transformers typically use cores made of layers of magnetic steel in a stacked or core configuration. The magnetic steel used is typically silicon steel or, more recently, amorphous steel. Amorphous steel has several advantages over silicon steel insofar as core losses are concerned. However, after annealing operations, used to enhance the magnetic characteristics of the steel, amorphous steel becomes rather brittle and somewhat fragile. This can create problems in handling the core. It also can result in small flakes or particles of the amorphous material being released into the transformer oil within which the transformer is typically submerged. This creates a concern that such errant flakes of amorphous material could get in the windings to cause short-circuiting between windings, causing failure of the transformer.

Cores of wound transformer core material are somewhat unstable: they often have a tendency to unwind or telescope, and/or distort from their original shape, when handled. This is particularly true with amorphous steel which lacks bending stiffness within the plane of the material due to its thin structure. To prevent this from occurring, the ends of coiled core material have been sealed using various adhesives and resins. See, for example, U.S. Pat. Nos. 4,924,201 and 4,910,863.

SUMMARY OF THE INVENTION

The present invention is directed to a core for an electrical transformer made of layered, typically coiled, amorphous transformer core material which is finished to (a) provide structural rigidity to the core, (b) allow air in the interlamination voids between the layers of core material to be replaced by insulating fluid, and (c) permit the core to be housed within a containment assembly which traps any small particles of core material and prevents them from escaping and contacting the transformer cores.

The layered amorphous transformer core material has a rigidifying bonding material applied to the ends of the core. The bonding material does not cover the entire ends but leaves small gaps to permit fluid flow between the ambient environment and the interlamination voids which exist between the layers of the wound core material. The core, rigidified by the bonding material, is housed within a fluid permeable containment assembly. The containment assembly is typically made of fluid permeable filter material which allows insulating fluid and air to pass through the filter material but traps particles of core material within the containment assembly.

It has been discovered that cores of wound amorphous transformer core material are typically about 18% air. That is, interlaminar voids take up about 18% of the overall volume Of the core. When these cores are sealed in a conventional manner to rigidify the cores and trap any particles of amorphous material, the air is also trapped. Many transformers are, however, immersed in an insulating fluid, such as transformer oil or sulphur hexafluoride gas, for insulation and heat dissipation. During use, the trapped air may, over time, escape through pinholes which may form in the adhesive layer covering the ends of the core. This escaped air, if it enters core windings which are immersed in transformer oil, can cause breakdown in the insulation structure resulting in transformer failure. For core windings which are immersed in sulphur hexafluoride gas, the escaped air dilutes the gas to reduce its insulating properties. In addition, the escaped air will generally contain water vapor; the water vapor can combine with the sulfur hexafluoride to create acids which can attack the transformer components, or degrade the insulating properties.

Unlike prior art methods which bond the ends of layered transformer core material by completely covering the ends, the present invention purposely leaves portions of the edges unbonded to provide fluid pathways into and out of the interlamination voids between the layers of the core material. With the present invention the advantages of obtaining a rigid transformer core, achieved in the prior art methods by completely covering the ends of the core, are achieved without sacrificing the ability to replace air within the interlamination voids with insulating fluid. Containment of particles of amorphous core material which might be present is achieved using the fluid permeable containment assembly surrounding the core.

Other features and advantages of the invention will appear from the following description in which the preferred embodiment has been set forth in detail in conjunction with the accompanying drawings.

DESCRIPTION OF THE PREFERRED EMBODIMENT

Figure 1:
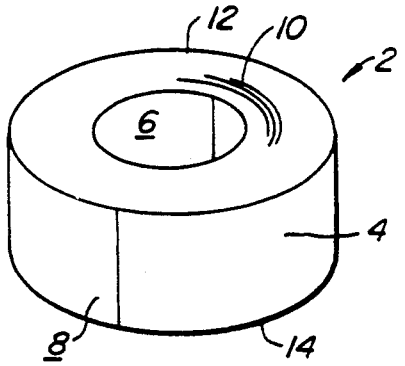
FIG. 1 is an isometric view of a core which is wound from amorphous transformer core material.

FIG. 1 illustrates a core 2 of wound amorphous transformer core material 4. Amorphous transformer core material 4 may be of the type sold by Allied-Signal, Inc. of Morris Township, N.J., as METGLAS. Core 2 has a generally cylindrical inside surface 6 a generally cylindrical outside surface 8. The edges 10 of material 4 define generally flat, annular ends 12, 14.

Figure 1A:
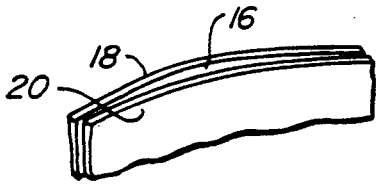
FIG. 1A is an enlarged end view of laminations of the core material of FIG. 1 illustrating, in exaggerated form, an interlamination void between layers of core material.
Figure 2:
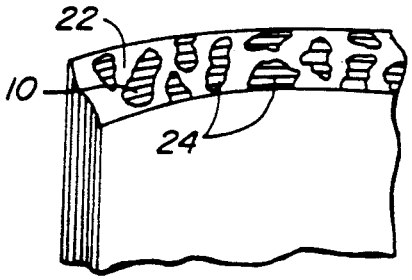
FIG. 2 is an enlarged view of a section of the core of FIG. 1 showing a bonding material applied to a portion of the end of the core.

Material 4 is about 0.001 inch (0.025 mm) thick. Once annealed, material 4 becomes relatively brittle so that handling core 2 must be done carefully to avoid damage to the core. One way to help prevent damage to the core 2 is to keep the core from telescoping out or unwinding, both of which will expose edges 10 to damage. Conventionally this has been accomplished by covering ends 12, 14 with some type of adhesive or resin to create a rigid structure. This, however, prevents the replacement of air within the interlamination voids 16, shown in an exaggerated form in FIG. 1A, between layers 18, 20 of material 4. Accordingly, with the present invention, as shown in FIG. 2, ends 12, 14 are partially covered with a bonding material 22 leaving gaps 24 exposing edges 10 of material 4 at end 12, 14. The percentage of ends 12, 14 which is covered by bonding material 22 is between about 50% and 95%, and preferably about 90%.

Bonding material 22 is preferably an epoxy-type adhesive. One suitable adhesive is made by 3M Corporation of Saint Paul, Minn. and is sold as #2216AB.

Bonding material 22 typically covers edges 10 and extends a distance into voids 16 between layers 18, 20. The degree to which this occurs depend upon the viscosity of bonding material 22, the affinity between bonding material 22 and transformer material 4, the size of voids 16, among others. Bonding material 22 is typically of the type which requires some time to cure to achieve its desired strength. However, if bonding material 22 is a quick- acting contact adhesive, the cure time could be, for practical purposes, reduced to zero. As used in this application, curing the bonding material is intended to cover situations in which the bonding material requires a measurable cure time and situations in which it requires essentially a zero cure time.

Figure 4:
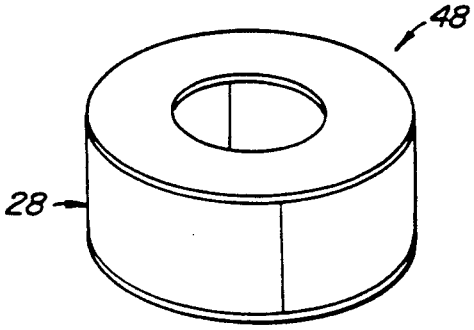
FIG. 4 shows the core of FIG. 3 in an assembled form.
Figure 3:
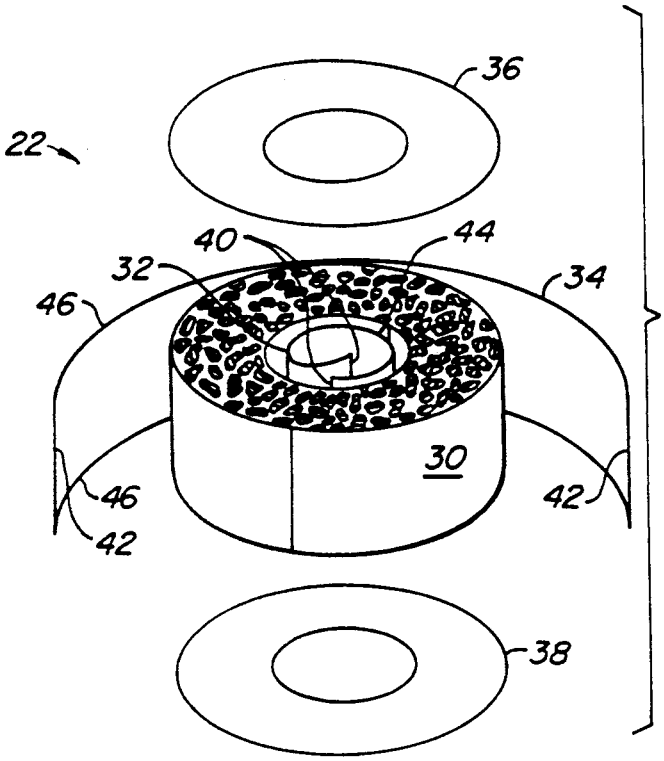
FIG. 3 is an exploded isometric view of the core of FIG. 1 with both ends bonded as suggested in FIG. 2, together with a particle containment assembly shown in an exploded relationship surrounding the core.

Next, as shown in FIG. 3. a containment assembly 28 is mounted over bonded core 30. Containment assembly 28 includes an inner wrapping strip 32, an outer wrapping strip 34, and end discs 36, 38. Containment assembly 28 is made of a material, such as transformer pressboard, which is permeable to both air and insulating fluids, but acts as a filter to trap particles of material 4 which may be present. Containment assembly 28 is held in place by securing the abutting or overlapping edges 40, 42 of inner and outer strips 32, 34 with a suitable adhesive: the circumferential edges 44, 46 of strips 32, 34 are bonded to the circumferential edges of end discs 36, 38. Alternatively, containment assembly 28 could, for example, be secured about bonded core 30 using an appropriate tape at the adjacent edges. The resulting combination of bonded core 30 and containment assembly 28 is shown as a completed core 48 in FIG. 4. The material from which containment assembly 28 is made preferably provides electrical insu1ation and mechanical protection for bonded core 30.

It is preferred that the circumferential edges 44, 46 of strips 32, 34 and the adjacent circumferential edges of discs 36, 38 overlap somewhat. Doing so helps to prevent any cores of transformer wire (not shown) which may be wound directly on the completed core 48 from contacting, and thus shorting out to, core 2.

Amorphous transformer cores are typically about 18% air when wound. If one were to seal the edges of a core of amorphous transformer material completely, this air would become trapped within the transformer core. However, during use pinholes might develop in the edge sealant which could allow air in interlamination voids to escape; the escaped air could get inside the windings resulting in a loss of cooling effectiveness, overheating, possible shorting, a loss in efficiency and a reduction in transformer life. With finished core 48, due to the presence of gaps 24 and the use of a material permeable to air and transformer insulating fluid for containment assembly 28, any air within interlamination voids 16 between layers 18, 20 of material 4 can be evacuated when the transformer, together with the finished core 48, is subjected to a partial vacuum and immersed in transformer insulating fluid, as is conventional.

In the embodiment of FIGS. 1-4, bonding material 22 is placed to provide numerous small, irregularly spaced and shaped gaps 24 to permit fluid flow into and out of core 2. However, other patterns of bonding material 22 could be used as well. In addition, entire ends 12, 14 could be covered with bonding material 22; selected portions of the bonding material would then be removed using a solvent, heat or mechanical means.

It has been found that in lieu of applying bonding material 22 directly to ends 12, 14, it is preferable that the bonding material be applied to the surfaces of end discs 36, 38 in a manner such that gaps are created when the discs are bonded to ends 12, 14. This bonding preferably takes place when the cores 2 are still warm from annealing (annealing being conventional) with discs 36, 38 being pressed against ends 12, 14. This has the advantage of eliminating one of the steps described above and of securing at least part of containment assembly 28 directly to core 2.

Figure 5:
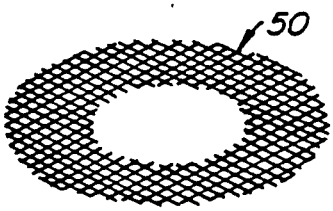
FIG. 5 illustrates a supplemental disc which can be used to apply the bonding material to the ends of the core of FIG. 1 while also bonding the end discs of the containment assembly of FIG. 3 to the ends of the core.

Instead of using transformer pressboard as the material for containment assembly 28, other types of material, such as Kraft paper or crepe paper tube, could be used as well. Strips 32, 34 need not be permeable to the insulation fluid so long as they act as a barrier to particles of material 4. Also, instead of applying bonding material 22 either directly to ends 12, 14 or to end discs 36, 38, the bonding material could be applied to a supplemental disc 50 as shown in FIG. 5. Disc 50 is made of an open-weave fabric having a very high porosity. After applying bonding material 22 in a suitable pattern to two supplemental discs 50, one supplemental disc 50 is then placed against each of first and second ends 12, 14. Supplemental discs 50 are made to allow bonding material 22 to seep through its thickness so that in addition to applying the bonding material to ends 12, 14 of core 2, supplemental disc 50 would also be used to bond end discs 36, 38 to the core through discs 50. Instead of an open-weave fabric, supplemental disc 50 could be made from other materials, such as spun-bonded fabric or felted fabric.

Other modifications and variations can be made to the disclosed embodiments without departing from the subject of the invention as defined in the following claims.

What is claimed is:

1. A method for finishing a core of layered amorphous transformer core material with the edges of the transformer material defining ends of the material, the transformer material defining interlamination voids between the layers of the transformer material, the method comprising the following steps:

applying a bonding material to the edges of the transformer core material covering a first portion of a first said end;

maintaining a second portion of the first end free of said bonding material, the second portion being formed of small gaps distributed throughout the entire first portion; and curing the bonding material thereby rigidifying said core of material.

2. The method of claim 1 wherein at least the second portion of the first end is covered by a fluid permeable filter material.

3. The finishing method of claim 1 wherein the applying step is carried out by applying the bonding material to the first end and a second said end.

4. The finishing method of claim 1 wherein the maintaining step is carried out by maintaining between about 5% and 50% of the first end free of said bonding material.

5. The finishing method of claim 1 wherein the applying step is carried out by applying the bonding material to a fluid-permeable layer and the bonding the fluid-permeable layer to the first end using the bonding material previously applied to the fluid-permeable material.

6. The finishing method of claim 1 further comprising the step of enclosing, after the curing step, the rigidified core of material with a particulate barrier material to form a particulate containment assembly which traps any particles of the wound material within the particulate containment assembly, at least a portion of the particulate barrier material including a fluid-permeable particulate filter material.

7. The finishing method of claim 6 further comprising the steps of:

placing the transformer material in a vacuum chamber;

subjecting the vacuum chamber to a vacuum to cause evacuation of air from the interlaminar voids through said second portion; and introducing transformer insulating fluid into the chamber while maintaining the vacuum until said core is immersed in said fluid. and then relieving said vacuum in said vacuum chamber.

8. A method for finishing a core of coiled amorphous transformer core material of the type having inner and outer surfaces with the edges of the coiled transformer core material defining the first and second ends of the material, the transformer core material defining interlamination voids between the layers of the transformer material, the method comprising the following steps:

applying a bonding material to the edges of the transformer core material covering about 50% to 95% of the first and second ends;

maintaining the remainder of the first and second ends free of said bonding material, the remainder of the first and second ends being formed of small gaps distributed throughout the entire first and second ends;

curing the bonding material thereby rigidifying the transformer core material;

covering the first and second ends with a fluid-permeable particulate filter material and the inner and outer surfaces with a particulate barrier material to form a particulate containment assembly which traps any particles of the wound material within the particulate containment assembly;

placing the rigidified, covered transformer core material in a vacuum chamber;

subjecting the vacuum chamber to a vacuum to cause evacuation of air from the interlaminar voids through said portions of said ends which are free of bonding material; and introducing transformer insulating fluid into the chamber while maintaining the vacuum until said core is immersed in said fluid, and then relieving said vacuum in said vacuum chamber.

9. The finishing method of claim 8 wherein the applying step is carried out by applying the bonding material to a fluid-permeable layer and then bonding the fluid-permeable layer to the first end using the bonding material previously applied to the fluid-permeable material.

10. A toroidal transformer core comprising:

a coil of amorphous transformer core material, the core having inner and outer circumferential surfaces, the material having edges which define first and second ends of the core, the material being wound in layers;

the material defining interlamination voids between the layers of the material;

a first core-rigidifying bonding layer covering a first portion of the first end leaving a second portion of the first end free of said first bonding layer to permit fluid flow to and from said interlaminar voids through said second portion while rigidifying said core and the second portion being formed of small gaps distributed throughout the entire first portion.

11. The core of claim 10 wherein the second portion is about 5% to 50% of the first end.

12. The core of claim 10 further comprising a second core-rigidifying bonding layer covering a third portion of the second end leaving a fourth portion of the second end free of said second bonding layer.

13. The core of claim 10 further comprising a fluid-permeable particulate filter layer encompassing at least the second and fourth portions of the first and second ends of the core of material.

14. The core of claim 13 wherein the filter layer closely covers the first and second ends.

15. The core of claim 13 wherein the inner and outer circumferential surfaces are covered by a particulate barrier material so as to fully enclose the core.

16. The core of claim 15 wherein the filter layers covering the first and second ends, and the particulate barrier material covering the inner and outer circumferential surfaces comprise an electrical insulating material.

17. The core of claim 10 wherein the coil of transformer core material is an uncut coil of transformer core material.

18. A toroidal transformer core comprising:

a coil of amorphous transformer core material, the coil having inner and outer circumferential surfaces, the material having edges which define first and second ends of the coil, the material being wound in layers;

the material defining interlamination voids between the layers of the material;

a first coil-rigidifying bonding layer covering about 50% to 95% of the first and second ends leaving the remainder of the first and second ends free of said first bonding layer to permit fluid flow to and from said interlaminar voids through said first and second ends while rigidifying said coil of material the remainder of the first and second ends being formed of small gaps distributed throughout the entire bonding layer; and a particulate barrier layer fully encompassing the rigidified core of material, at least a portion of the barrier layer being fluid-permeable.

* * * * *